United States Patent [19]

Calabrese

[11] 4,277,161

[45] Jul. 7, 1981

[54] CLEANER FOR PRESSURE FIXING ROLLER

[75] Inventor: Richard A. Calabrese, Newtown, Conn.

[73] Assignee: Pitney Bowes, Inc., Stamford, Conn.

[21] Appl. No.: 102,217

[22] Filed: Dec. 10, 1979

[51] Int. Cl.[3] ..... G03G 15/00

[52] U.S. Cl. ..... 355/3 FU; 15/256.52; 219/216; 355/15; 432/75

[58] Field of Search ..... 355/3 FU, 15; 219/216, 219/388; 118/652, 203; 15/256.5, 256.51, 256.52; 432/75

[56] References Cited

U.S. PATENT DOCUMENTS

| | | | |
|---|---|---|---|
| 3,766,592 | 10/1973 | Suzuki | 15/256.51 |
| 3,861,860 | 1/1975 | Thettu et al. | 15/256.52 X |
| 3,861,861 | 1/1975 | Thettu | 15/256.52 X |
| 3,868,744 | 3/1975 | Thettu | 15/256.52 |
| 3,929,094 | 12/1975 | Thettu | 432/75 X |
| 3,929,095 | 12/1975 | Thettu | 432/75 X |
| 3,940,238 | 2/1976 | Bar-on | 432/75 |
| 3,941,558 | 3/1976 | Takiguchi | 355/15 X |
| 3,966,394 | 6/1976 | Braun | 15/1.5 R |
| 4,018,555 | 4/1977 | Thettu | 219/216 X |

*Primary Examiner*—R. L. Moses

*Attorney, Agent, or Firm*—Lawrence E. Sklar; William D. Soltow, Jr.; Albert W. Scribner

[57] ABSTRACT

A cleaning device for a fixing roller in an electrostatic copying machine, comprising a cleaner support mountable adjacent the fixing roller, a porous oil-impregnated roller rotatably mounted adjacent the cleaner support, a cleaning felt adjustably secured about the cleaner support and the oil-impregnated roller, means for urging the cleaning felt into wiping contact with the fixing roller, and means for incrementally advancing the cleaning felt in wiping contact with the fixing roller can be maintained clean.

8 Claims, 3 Drawing Figures

CLEANER FOR PRESSURE FIXING ROLLER

BACKGROUND OF THE INVENTION

The instant invention relates to electrostatic copiers and more particularly to a cleaning device for a fixing roll of a pressure fixing roll pair.

Conventionally, in the direct or indirect electrostatic copying process for the fixing of a developed image formed of a proper toner on a permanent record carrier, such as paper, various fixing processes may be used. According to a known fixing process, the paper sheet is passed between a heated fixing roller and a pressure roller which is in engagement with the fixing roller. During this step the powder of the toner image is melted on the paper and is caused to adhere thereto. This process, however, still has certain drawbacks. A portion of the toner sticks to the circumferential surface of the fixing roller which contacts the toner image; these adhered residues then are transferred to the paper sheet, thus causing soiling thereof. In case the temperature of the fixing roller is too low, unmelted powder adheres thereto and is pressed, in an offset-like manner, onto the successive record carriers. If, on the contrary, the temperature of the fixing roller is too high, melted powder may adhere thereto and again, soil the successive sheets. In order to prevent such an offset soiling of the paper sheets, it is necessary to carefully control the fixing temperature. Such a control of the fixing temperature is, however, fraught with difficulties.

More recently, due to the availability of new toners, another fixing process has been introduced wherein the toner image is fixed without the use of heat by means of generating a sufficiently high pressure between the two rollers. In this process too, after the pressure fixing, a certain quantity of toner remains on the circumferential surface of the fixing roller which had contacted the toner image; these toner portions have to be removed as well, since the residual toner adhering to the fixing roller would again lead to the above-noted offset soiling of the paper sheets.

It is known to arrange a silicone oil-impregnated cleaning felt in contact with the fixing roller to prevent the above-noted offset soiling. The cleaning felt is conventionally formed of a thick felt strip which is inserted in a U-shaped holder and is immobilized on both sides. It is also known, from U.S. Pat. No. 4,137,597 issued Feb. 6, 1979, to dispose a cleaning felt around a star-like frame in order to provide a plurality of cleaning felt portions. These prior art cleaning felt arrangements work well but have a limited continuous service life, necessitating frequent or occasional replacement. The instant invention provides a cleaning device for a fixing roller in an electrostatic copying machine which is capable of rendering continuous service for the full life of the electrostatic copier in which it is employed.

SUMMARY OF THE INVENTION

Accordingly, the instant invention provides a cleaning device for a fixing roller in an electrostatic copying machine, comprising a cleaner support mountable adjacent said fixing roller, a porous, oil-impregnated roller rotatably mounted adjacent said cleaner support, a cleaning felt adjustably secured about said cleaner support and said oil-impregnated roller, means for urging said cleaning felt into wiping contact with said fixing roller, and means for incrementally advancing the cleaning felt past the fixing roller, whereby the portion of the felt in wiping contact with the fixing roller can be maintained clean.

DETAILED DESCRIPTION

Figure 1:
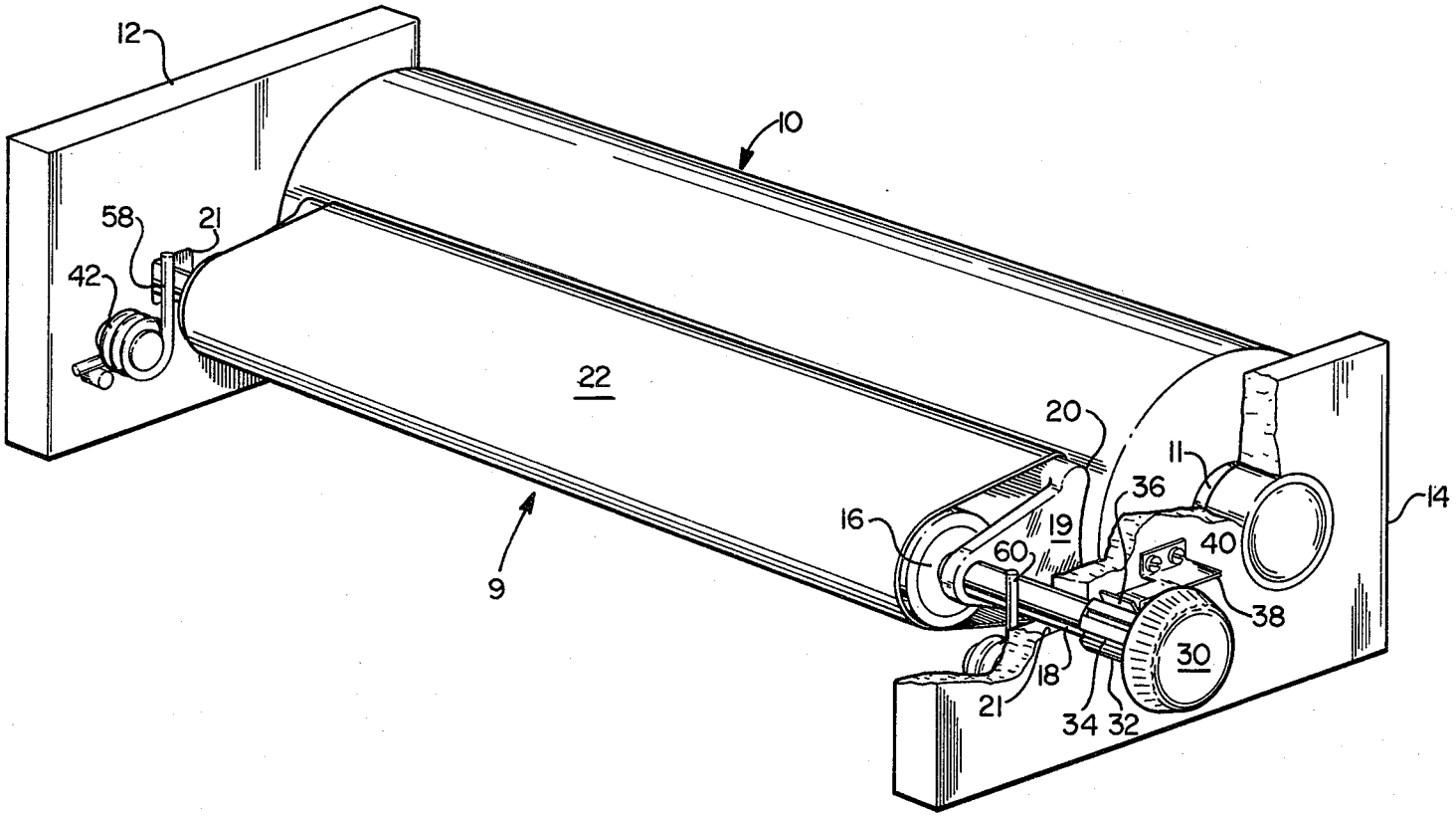
FIG. 1 is a perspective view of a cleaning device for a fixing roller in accordance with the instant invention.

In describing the preferred embodiment, reference is made to the drawings, wherein there is seen a cleaning device generally designated 9 for pressure fixing roller 10 fixedly secured to a shaft 11 which is rotatably mounted in side frames 12 and 14 of an electrostatic copier housing (not shown). The cleaner device 9 includes a porous roller 16 fixedly mounted about a shaft 18 which in turn is rotatably mounted in the lateral flanges 19 of a cleaner support 20 and adjustably rotatably mounted in apertures 21 in the side frames 12 and 14. An endless felt member 22 is wrapped around the porous roller 16 and the arcuate, longitudinally extending, roller engaging section 24 of the cleaner support 20 to form a continuous cleaning felt.

The porous roller 16 comprises a steel mandrel 26 fixedly mounted on or part of the shaft 18 and an open cell foam sleeve 28 secured about the periphery of the mandrel 26. The sleeve 28 may also comprise a felt or any other kind of absorptive material. The foam sleeve 28 is impregnated with silicone oil and acts as a wick to supply oil to the continuous cleaning felt 22.

A knob 30 having a collar 32 is fixedly secured about the shaft 18. The collar 32 is provided with a multiplicity of slots 34 for accommodating the depressed flange 36 at the end of a leaf spring 38 which is secured to the side frame 14 by means of two screws 40 and which should be strong enough to prevent accidental rotation of the shaft 18. A pair of torsion springs 42 and 44 are mounted on a pair of studs 46 and 48 respectively. The ends 50 and 52 of torsion springs 42 and 44 respectively abut against projections 54 and 56 respectively while the other ends 58 and 60 of the torsion springs 42 and 44 respectively abut against the shaft 18, thereby urging the roller engaging section 24 of the cleaner support 20 and the portion of the continuous cleaning felt 22 lying thereover into wiping contact with the fixing roller 10.

Figure 2:
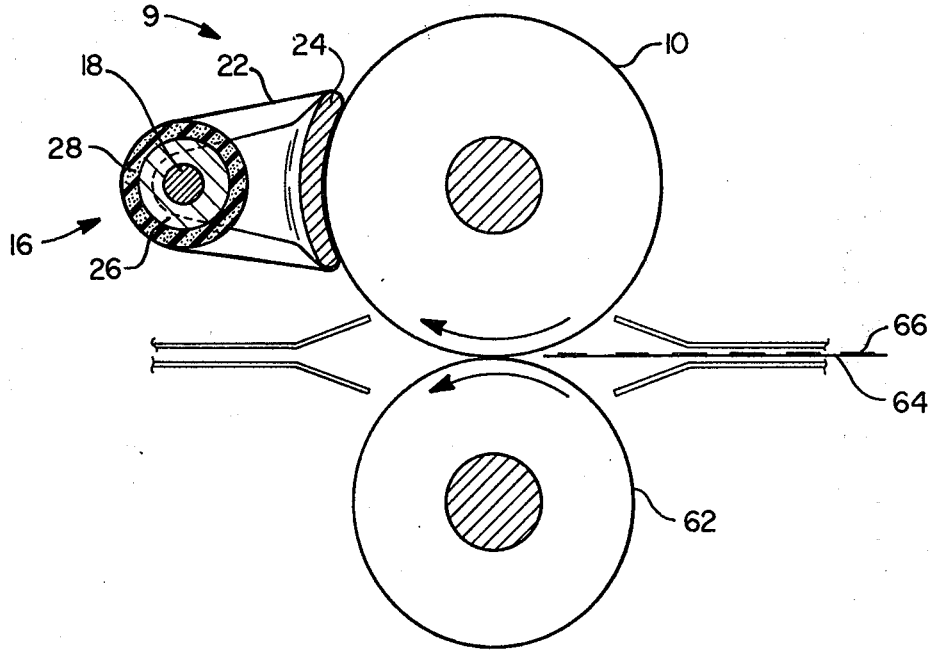
FIG. 2 is a vertical sectional view of a pair of fixing rollers and a cleaning device therefor in accordance with the instant invention.
Figure 3:
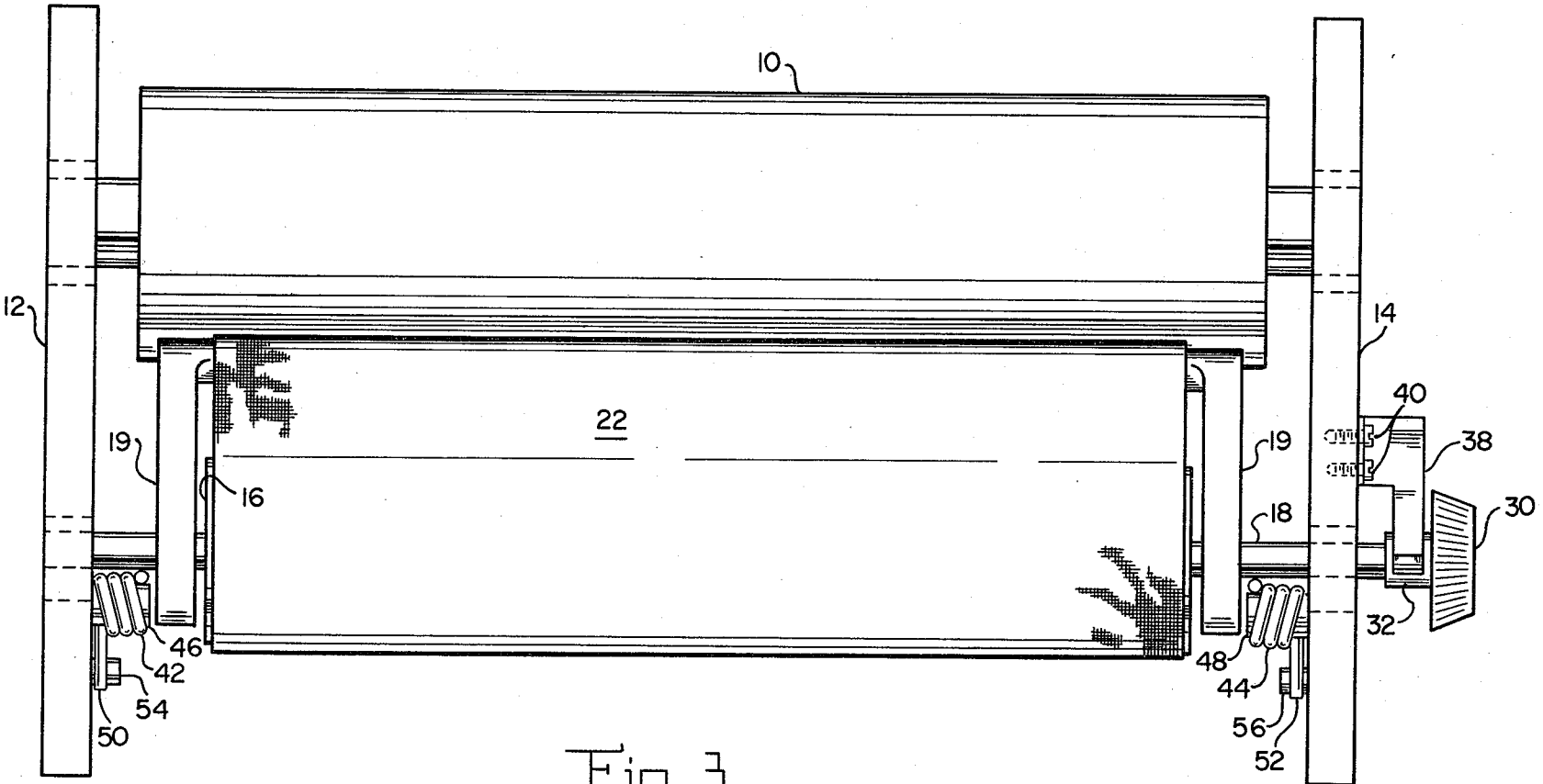
FIG. 3 is a top plan view of the roller and cleaning device seen in FIG. 2.

To understand the operation of the cleaning device 9, reference is mae to FIG. 2, wherein a second roller 62 has been added to the apparatus shown in FIG. 1. Copy paper 64 having unfused toner particles 66 on the top surface is conveyed toward the pair of pressure fixing rollers 10 and 62 which fuse the toner particles 66 to the copy paper 64. Any toner particles that remain adhered to the upper fixing roller 10 are then removed by the wiping contact with the continuous cleaning felt 22.

Whenever the portion of the continuous cleaning felt 22 in contact with the fixing roller 10 becomes sufficiently soiled to require replacement, a clean section of cleaning felt may be advanced into proper position by merely rotating the knob 30 a sufficient distance to completely remove the soiled section of cleaning felt 22 from contact with the roller 10. Obviously, the amount of rotation will depend on several factors, such as the diameter of the shaft 18, the size of the roller engaging section 24 of the cleaner support 20, etc. Also,, the stopping point will depend to a certain extent on the number and placement of the multiplicity of slots 34. Since the cleaning felt 22 makes wiping contact with the fixing roller 10 for only about one inch in the circumferential direction of the roller 10, clearly there is enough cleaning felt 22 to provide enough clean surface positions for the life of virtually any photocopying machine.

While only a single embodiment has been illustrated and described, it will be apparent to those skilled in the art that various modifications and improvements may be made without departing from the scope and spirit of the invention. Accordingly, it is to be understood that the invention is not to be limited by the illustrative embodiment, but only by the scope of the appended claims.

What is claimed is:

1. A cleaning device for a fixing roller in an electrostatic copying machine, comprising:
- a cleaner support mountable adjacent said fixing roller;
- a porous, oil-impregnated roller rotatably mounted adjacent said cleaner support;
- a continuous cleaning endless felt member adjustably secured around said cleaner support and said oil-impregnated roller;
- means for urging said endless felt member into wiping contact with said fixing roller; and
- means for incrementally advancing said endless felt member past the fixing roller, whereby the portion of the felt in wiping contact with the fixing roller can be maintained clean.

2. The cleaning device of claim 1, wherein the porous, oil-impregnated roller comprises a mandrel having an open cell foam sleeve secured about the periphery thereof.

3. The cleaning device of claim 2, wherein the open cell foam sleeve is impregnated with silicone oil.

4. In combination, a fixing roller in an electrostatic copying machine and a cleaning device for said fixing roller, said cleaning device comprising:
- a cleaner support mounted adjacent said fixing roller;
- a porous, oil-impregnated roller rotatably mounted adjacent said cleaner support;
- a continuous cleaning endless felt member adjustably secured around said cleaner support and said oil-impregnated roller;
- means for urging said endless felt member into wiping contact with said fixing roller; and
- means for incrementally advancing said endless felt member past the fixing roller, whereby the portion of the felt in wiping contact with the fixing roller can be maintained clean.

5. The combination of claim 4, wherein the fixing roller is a cold pressure roller.

6. The combination of claim 4, wherein the fixing roller is a heated roller.

7. The combination of claim 4, wherein the porous, oil-impregnated roller comprises a mandrel having an open cell foam sleeve secured about the periphery thereof.

8. The combination of claim 7, wherein the open cell foam sleeve is impregnated with silicone oil.

* * * * *